US006994145B2

(12) United States Patent
Killo et al.

(10) Patent No.: US 6,994,145 B2
(45) Date of Patent: Feb. 7, 2006

(54) MOTORIZED DRAPERY PULL SYSTEM

(75) Inventors: Jason C. Killo, Emmaus, PA (US); Stephen D. Dauerbach, Coopersburg, PA (US); Jason S. Gottschall, Harleysville, PA (US); Todd M. Shirk, Kutztown, PA (US); Joel S. Spira, Coopersburg, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/165,148

(22) Filed: Jun. 7, 2002

(65) Prior Publication Data

US 2003/0121621 A1 Jul. 3, 2003

Related U.S. Application Data

(63) Continuation-in-part of application No. 10/039,787, filed on Jan. 2, 2002.

(51) Int. Cl.
*A47H 1/00* (2006.01)

(52) U.S. Cl. ..... 160/331; 160/346

(58) Field of Classification Search ..... 160/331, 160/346, 347, 345; 16/87.6 R, 95 R, 91, 16/97; 104/89, 93–95; 105/155
See application file for complete search history.

(56) References Cited

U.S. PATENT DOCUMENTS

| | | | | | |
|---|---|---|---|---|---|
| 365,240 | A | * | 6/1887 | Coburn | 104/108 |
| 2,786,522 | A | | 3/1957 | Weber | |
| 3,129,751 | A | * | 4/1964 | Weber | 160/345 |
| 3,293,685 | A | | 12/1966 | Rosenbaum | |
| 3,365,966 | A | * | 1/1968 | Heyer | 474/62 |
| 3,753,457 | A | * | 8/1973 | Bratschi | 160/331 |
| 3,808,483 | A | * | 4/1974 | Kembuegler et al. | 318/436 |
| 4,062,146 | A | | 12/1977 | Grossman et al. | |
| 4,299,008 | A | * | 11/1981 | Burns | 16/95 D |
| 4,492,262 | A | * | 1/1985 | Comeau | 160/126 |
| 4,525,893 | A | * | 7/1985 | Fukada | 16/102 |
| 5,041,063 | A | * | 8/1991 | Breher et al. | 474/205 |
| 5,791,394 | A | | 8/1998 | Huang | |
| 2002/0162189 | A1 | * | 11/2002 | Whitley | 16/91 |

FOREIGN PATENT DOCUMENTS

| | | | |
|---|---|---|---|
| JP | 3-280907 | * | 3/1990 |
| NL | 1019467 | * | 12/2002 |

* cited by examiner

*Primary Examiner*—Blair M. Johnson
(74) *Attorney, Agent, or Firm*—Drinkler Biddle & Reath LLP

(57) ABSTRACT

A quiet drapery pull system includes an elongated track that receives a master car and auxiliary cars. The track defines a pair of curved surfaces for nested receipt of roller members of the cars to facilitate linear tracking of the cars. The cars preferably include tires that are made from a resilient material to limit noises caused by rolling contact and by slipping and dragging of the tires upon contact with surface imperfections of the track. The drapery pull system preferably includes a drive belt connected to a reversible motor and to the master car for driving the master car in each of opposite directions. The drive belt is preferably made from a resilient material to limit noise associated with contact between the drive belt and drive pulley and between the belt and the track.

9 Claims, 11 Drawing Sheets

MOTORIZED DRAPERY PULL SYSTEM

CROSS REFERENCE TO RELATED APPLICATIONS

This is a continuation-in-part application of co-pending application Ser. No. 10/039,787, filed Jan. 2, 2002.

FIELD OF THE INVENTION

The present invention relates to a motorized drapery pull system for moving suspended drapery and the like, and more particularly to a quiet motorized drapery pull system that drives a belt for moving a master car and a plurality of auxiliary cars.

BACKGROUND OF THE INVENTION

Motorized drapery pull systems, for moving suspended drapery, are known in the art. Known systems include a drive unit having a reversible motor that turns a drive pulley for moving a drive belt within an elongated track. The drive belt is connected to a master car to provide movement of the master car in each of two opposite directions depending on the direction that the reversible motor is driving the drive belt. The motor and other moving parts of the drive system create noise. Noise is also generated by contact between the drive belt and drive pulley as the drive belt is turned about the drive pulley. The drive belt also generates scrubbing noises as the moving drive belt contacts portions of the stationary elongated track in which the drive belt is being driven. The likelihood of scrubbing contact between the drive belt and the elongated track increases when the drive belt is subject to memory formations in the vicinity of the pulleys. The term "memory" refers to the drive belt taking a set when it is held in place around the pulleys.

The master cars of known drapery pull systems include wheels received within the track to provide rolling movement of the cars. An elongated slot is provided in the track for connection between the cars positioned within the track and suspended drapery. Rolling contact between the wheels of the master car and the surface of the track generates noise. Contact noises are increased when the wheels skip or drag over surface imperfections in the track. The relatively hard surfaces of the wheels and the track exacerbate the noise generated by prior art drapery pull systems. Scrubbing contact between the master car and the track also generates noise.

The auxiliary cars of known drapery pull systems also include wheels received within the track for rolling movement of the cars. The auxiliary cars do not engage the drive belt. Instead, the suspended drapery is attached to each of the auxiliary cars such that movement of the drapery by the master car results in movement of the attached auxiliary cars. The auxiliary cars of known drapery systems include a single pair of wheels for rolling support of the cars. This construction renders non-linear tracking of the auxiliary cars within the track more likely as the cars are moved. Similar to the master car, the auxiliary cars are a source of noise from rolling contact as well as skipping and dragging of the wheels over surface imperfections. Non-linear tracking of the auxiliary cars renders scrubbing contact between the cars and the tracks, and the associated noise, more likely.

SUMMARY OF THE INVENTION

According to the present invention, there is provided a drapery pull system for moving a suspended drapery having a construction that results in extremely quiet normal operation. The drapery pull system includes an elongated track comprising a housing portion that defines a car compartment. The drapery pull system includes a master car received within the car compartment of the track having at least one pair of rotatably supported roller members. The drapery pull system further includes a plurality of auxiliary cars received within the car compartment of the track each having a pair of rotatably supported roller members.

Each of the roller members of the master car and auxiliary cars includes a portion that defines a surface that is curved in cross section. The curved surface of the roller members engages a pair of curved surfaces that are defined by the car compartment of the track. The curved surfaces of the track are adapted to provide for nested receipt of the roller members by the track to facilitate a substantially linear tracking of the master car and auxiliary cars within the car compartment of the track. The linear tracking of the cars facilitates quiet operation by limiting contact between the moving cars and the track.

The roller members of the cars preferably include tires that are made from a soft, resilient material to limit noises caused by rolling contact between the cars and the track. The resilient tires also reduce noise caused by slipping and dragging of the tires upon contact with surface imperfections in the surface of the track.

The drapery pull system further includes a drive system having a motor and a drive shaft rotatably driven by a reversible motor. The drive system preferably includes a pulley driven drive shaft connected to the master car for driving the master car in each of opposite directions depending on the rotational direction of the drive shaft by the reversible motor. The drive belt is preferably made from a soft, resilient material to limit noise associated with contact between the drive belt and drive pulley and scrubbing between the belt and the track.

The master car is attachable to a drapery to provide for movement of the drapery. Each of the auxiliary cars is also attachable to the drapery to provide for rolling support of the drapery when the drapery is moved by the master car.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE PREFERRED EMBODIMENT

Figure 1:
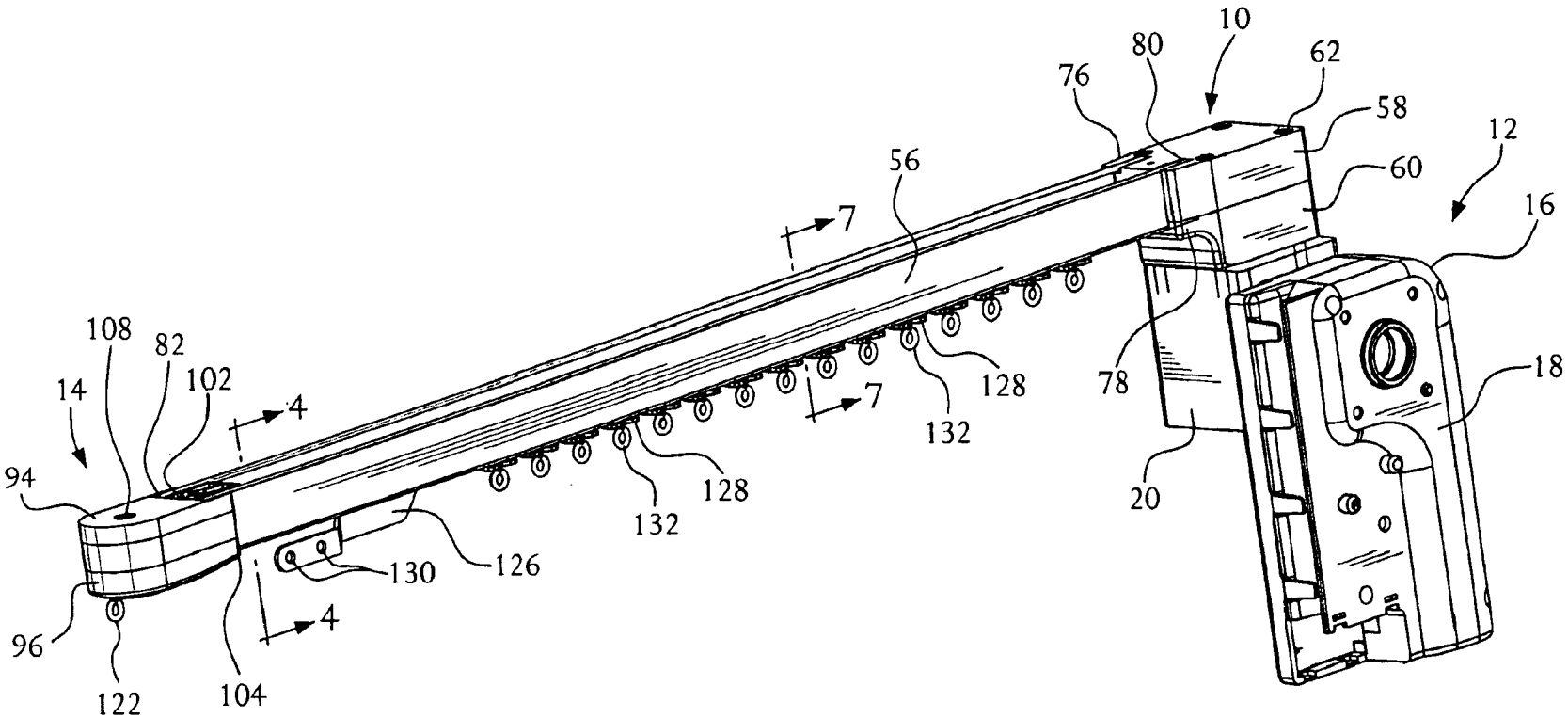
FIG. 1 is a perspective view of a drapery pull system according to the present invention.

Referring to the drawings where like numerals refer to like elements, there is shown a drapery pull system 10 according to the present invention. The construction of the drapery pull system 10 provides for motorized movement of suspended drapery that is accompanied by only limited amounts of noise generated by the components of the drapery pull system. In fact, depending on the suspended drapery, the noise that is generated by the drapery pull system 10 may be less than that generated by movement of the drapery itself.

As will be described in greater detail, the drapery pull system 10 utilizes soft, resilient materials for certain components, specifically various moving components that are responsible for a large portion of the noise generated by the drapery pull system. The hardness of materials such as rubber, elastomers and plastics is commonly tested by a device known as a durometer. A durometer includes a blunt point that is impressed on the surface of the material being tested to measure the resistance to non-puncturing penetration of the point against the action of a spring. The scale of a Shore durometer tester ranges from 0 to 100. There are several Shore hardness gauges that can be used to measure hardness including for example, Shore A and D. Although a material can be measured on either of these scales, the Shore A scale is typically used to measure softer rubber and elastomeric materials while Shore D is typically used to measure hard rubbers and plastics.

Figure 2:
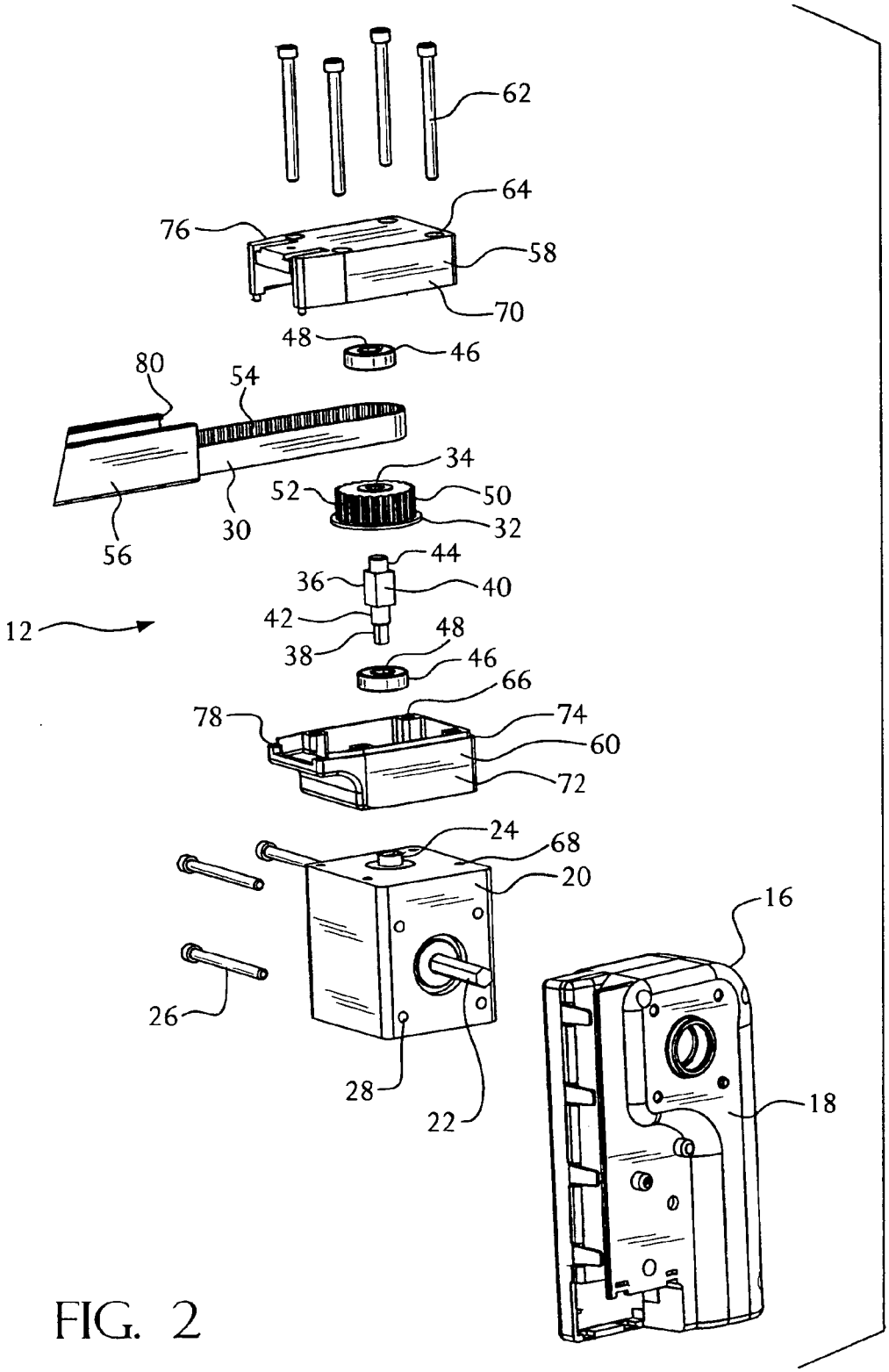
FIG. 2 is an exploded perspective view of the drive end of the drapery pull system of FIG. 1.
Figure 2A:
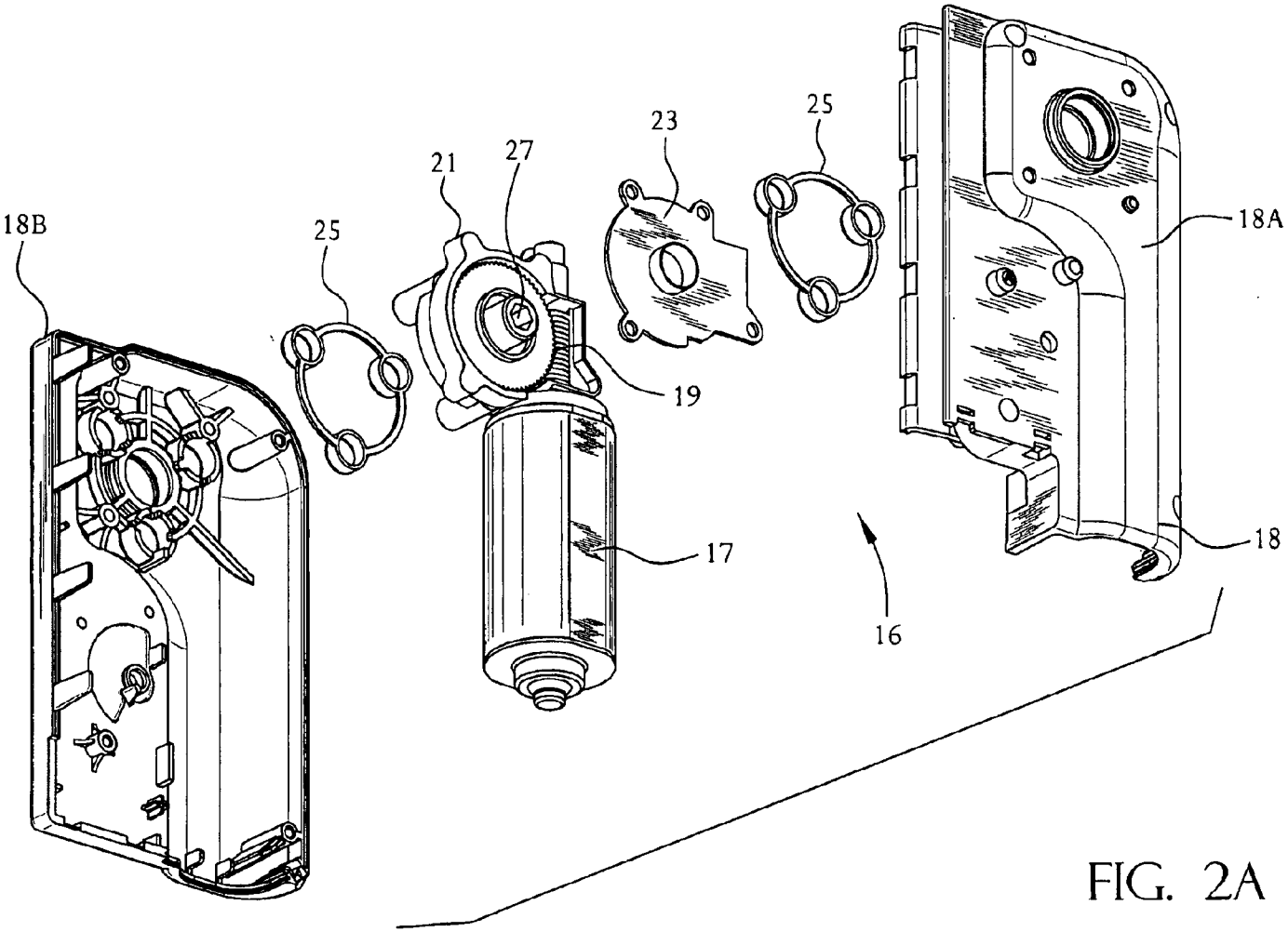
FIG. 2A is an exploded perspective view illustrating the drive unit of FIG. 2.
Figure 3:
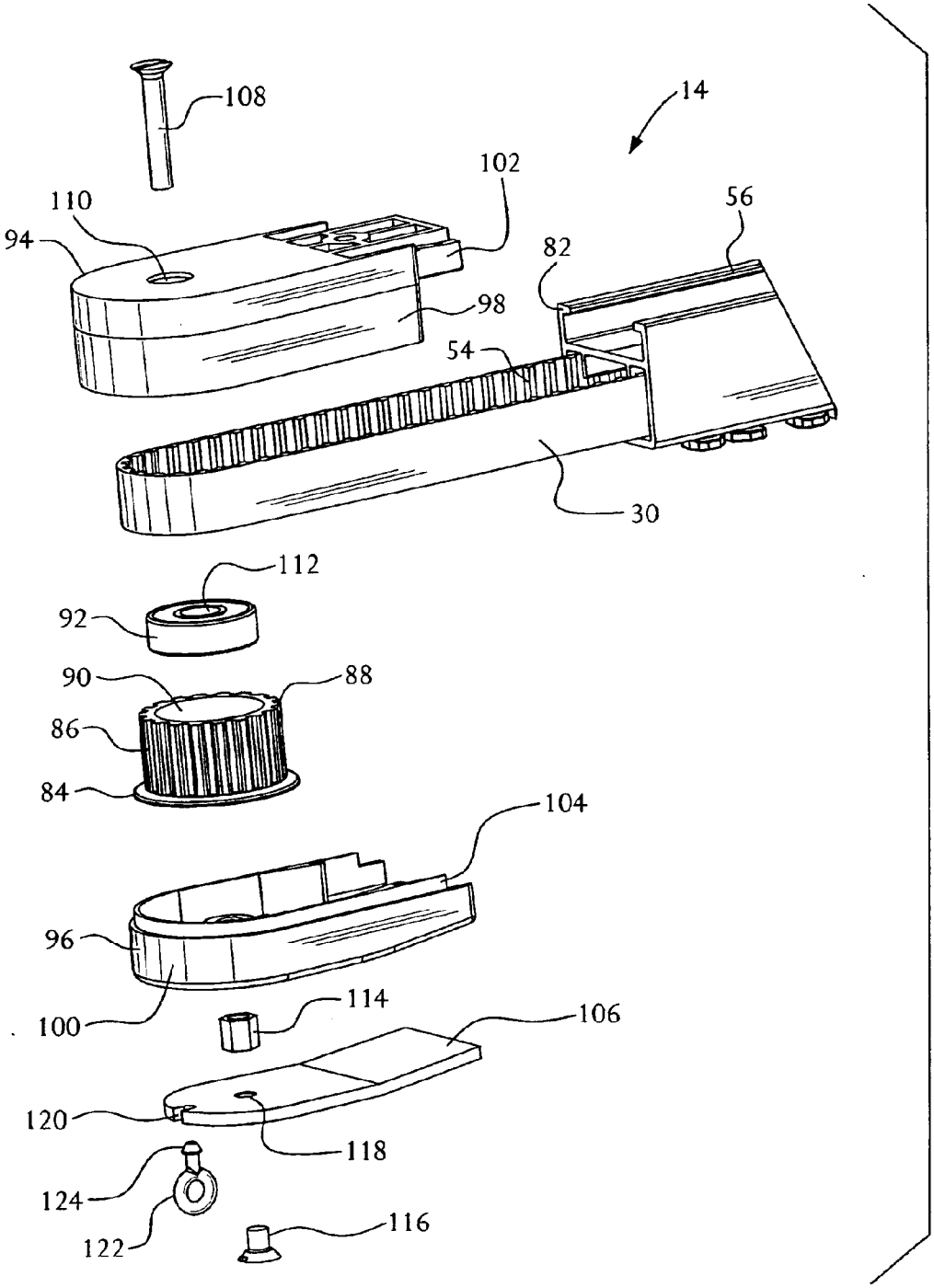
FIG. 3 is an exploded perspective view of the idler end of the drapery pull system of FIG. 1.

Referring to FIGS. 1–3, the drapery pull system 10 includes a drive end 12 and an idler end 14 to be described in greater detail below. The drive end 12 includes a drive unit 16 having a reversible motor 17 and a worm gear right angle drive 19, as illustrated in FIG. 2A, contained in a housing 18. The motor 17 and worm gear right angle drive 19 are contained within the housing 18 having first and second portions 18A and 18B. The drive unit 16 further includes a sub-housing 21 having a cover 23 for enclosing the worm gear right angle drive 19 within the housing 18. The drive unit 16 also includes a pair of positioning rings 25 for support of the motor 17 and right angle drive 19 within the housing 18. The worm gear right angle drive 19 functions to transfer rotation of the motor output to rotation of a socket member 27 in a substantially perpendicular direction. The reversible motor of the drive unit 16 is preferably a DC motor connectable to a standard wall receptacle through a low voltage transformer and control circuitry (not shown).

The drive end 12 further includes a gearbox 20 having a hexagonal shaft 22 that extends from the gearbox for receipt by socket member 27 of drive unit 16 within housing 18. The gearbox 20 houses a right angle drive (not shown) that functions to transfer rotation of shaft 22 about an axis that is substantially horizontal (in the orientation shown in the figures) to rotation of a socketed fitting 24 about an axis that is substantially vertical. Such rotational transfer between perpendicular axes of rotation, as by bevel gears for example, is well known in the art and therefore no further description is required. The drive unit 16 is secured to the gearbox 20 by bolts 26 that extend though openings 28 in the gearbox 20 for receipt by the housing 18 of drive unit 16.

The drapery pull system 10 includes a drive belt 30 driven by the drive unit 16 through a drive pulley 32. The drive pulley 32 includes a central opening 34 that extends through the drive pulley 32 to provide for receipt of a drive end shaft 36. The drive end shaft 36 includes a first torque transfer portion 38 received by the socketed fitting 24 of gearbox 20. The first torque transfer portion has a cross section adapted for cooperative engagement with the socketed fitting 24 of gearbox 20 for transferring rotation of the fitting 24 to rotation of the drive end shaft 36. The drive end shaft 36 further includes second torque transfer portion 40 located intermediately of the drive end shaft 36. The second torque transfer portion 40 has a substantially square cross section adapted for receipt by a cooperatively formed portion (not shown) of the drive pulley 32 to transfer rotation of the drive end shaft 36 to rotation of the drive pulley 32. The drive end shaft 36 includes first and second bearing receiving portions 42 and 44, respectively, located on opposite ends of the second torque transfer portion 40. Each of the first and second bearing receiving portions 42, 44 is adapted for receipt by an opening 48 of a bearing 46.

The drive pulley 32 includes a belt engaging portion 50 having notches 52 formed about an outer surface thereof. The notches 52 engage cooperatively formed teeth 54 on an inner surface of the belt 30 to facilitate transfer of rotation of the drive pulley 32 into movement of the drive belt 30. To reduce noise generated by the moving components of the drapery pull system 10, the drive belt 30 is made from a soft resilient material. Preferably, the resilient material is polyurethane having a hardness between 80 and 94 durometer on the Shore A scale and most preferably 92. In comparison, drive belts of prior art drapery pull systems have been measured to have a hardness that exceeds about 95 durometer on the Shore A scale. The use of the soft material for the drive belt 30 reduces noise associated with contact between the drive belt 30 and other components of the drapery pull system 10, such as the drive pulley 32 and a track 56 to be described in greater detail. The use of the soft material for the drive belt 30 renders the belt more flexible. Increased flexibility for the drive belt 30 reduces the likelihood that the drive belt will retain a memory set when the belt is held in position around the pulleys. Such a set retained in the drive belt 30 could result in contact between the drive belt 30 and the track 56 generating noise. The teeth of drive belt 30, in addition to facilitating engagement with the notches of the drive pulley 32, also serve to increase flexibility of the drive belt 30 and helps to further reduce noise. Optionally, as shown in the cross sectional view of FIG. 7, reinforcing wires 57 may be incorporated into the drive belt 30 to increase the tensile strength of the drive belt. Preferably, the reinforcing wires 57 are made from flexible stranded wire. However, the reinforcing wires 57 could comprise any suitable material or flexible member for increasing the tensile strength of the drive belt 30.

The drive end 12 of drapery pull system 10 includes top and bottom drive end caps 58, 60, respectively, secured to one another by bolts 62 that extend through openings 64, 66, respectively, in the top and bottom drive end caps 58, 60. The bolts 62 engage openings 68 in the gearbox 20 to secure the drive end caps 58, 60 to the gearbox 20. The drive end caps 58, 60 include housing portions 70, 72, respectively, for enclosing the drive pulley 32 and the drive end of the drive belt 30. The housing portion 72 of the bottom drive end cap 60 includes a recessed notch 74 to provide for interfit between top and bottom drive end caps 58, 60 as seen in FIG. 1. Each of the top and bottom drive end caps 58, 60 also includes a track engaging end 76, 78, respectively. The track engaging ends 76, 78 are adapted for engaging receipt of an end 80 of the elongated track 56 as seen in FIG. 1.

Referring to FIG. 3, the construction of the idler end 14 of the drapery pull system 10, located at an end 82 of track 56 opposite end 80, is shown. The idler end 14 includes an idler pulley 84 having notches 88 formed on an outer surface of a belt receiving portion 86. In a similar fashion to the notches 52 of the drive pulley 32, the notches 88 engage the teeth 54 of belt 30 to facilitate transfer of movement of the belt 30 to rotation of the idler pulley 84. The idler pulley 84 includes a central opening 90 for receipt of a bearing 92.

The idler end 14 of drapery pull system 10 further includes top and bottom end caps 94, 96, respectively. In a similar manner to the drive end caps 58, 60, the idler end caps 94, 96 have housing portions 98, 100, respectively, that function to enclose the idler pulley 84 and the idler end of the drive belt 30. Also in a similar manner to the drive end caps 58, 60, each of the idler end top and bottom caps 94, 96 includes a track engaging end 102, 104, respectively, for engaging receipt of end 82 of track 56 as seen in FIG. 1. The idler end 14 also includes an end cap plate 106 that is secured to the idler end bottom cap 96.

The idler end 14 is assembled in the following manner. Bearing 92 includes an opening 112 that is received on a boss (not shown) in housing 100. A first screw 108 extends through the boss and the opening 112 of bearing 92. A nut 114 threadedly receives an end of the first screw 108. A second screw 116 is received by an opening 118 in end cap plate 106 and engages an end of the nut 114 opposite the first screw 108. The engagement of the first and second screws 108 and 116 to the nut 114 serves to secure the idler end bottom cap 96 to both the idler end top cap 94 and the end cap plate 106. The end cap plate 106 includes a notch 120 that provides an opening when the end cap plate 106 is secured to the idler end bottom cap 96 for snap receipt of the tapered end 124 of an eye 122.

The drapery pull system 10 includes a master drive car 126 and a plurality of auxiliary drapery support cars 128. The master car 126 includes openings 130 that provide for attachment of drapery to the master car 126, through drapery hooks, for example, in the well known manner. Each of the auxiliary cars 128 includes a drapery support eye 132 providing for attachment of suspended drapery to the auxiliary car 128, by drapery hooks for example. As will be described in greater detail, the master car 126 is attached to the drive belt 30 such that the master car 126 will be driven in the track 56 by the drive belt 30. The auxiliary cars 128 are not attached to the drive belt 30 and, therefore, will not be directly driven by the drive belt 30. Depending on the direction in which the master car 126 is driven, the auxiliary cars 128 will be pulled by virtue of the movement of the drapery by the master car 126 or will be pushed by contact between adjacent cars or through compression of interconnecting drapery between adjacent cars. In the perspective shown in FIG. 1, the auxiliary cars will be pulled when the drive belt 30 drives the master car 126 to the left and will be pushed when the drive belt 30 drives the master car 126 to the right.

Figure 5:
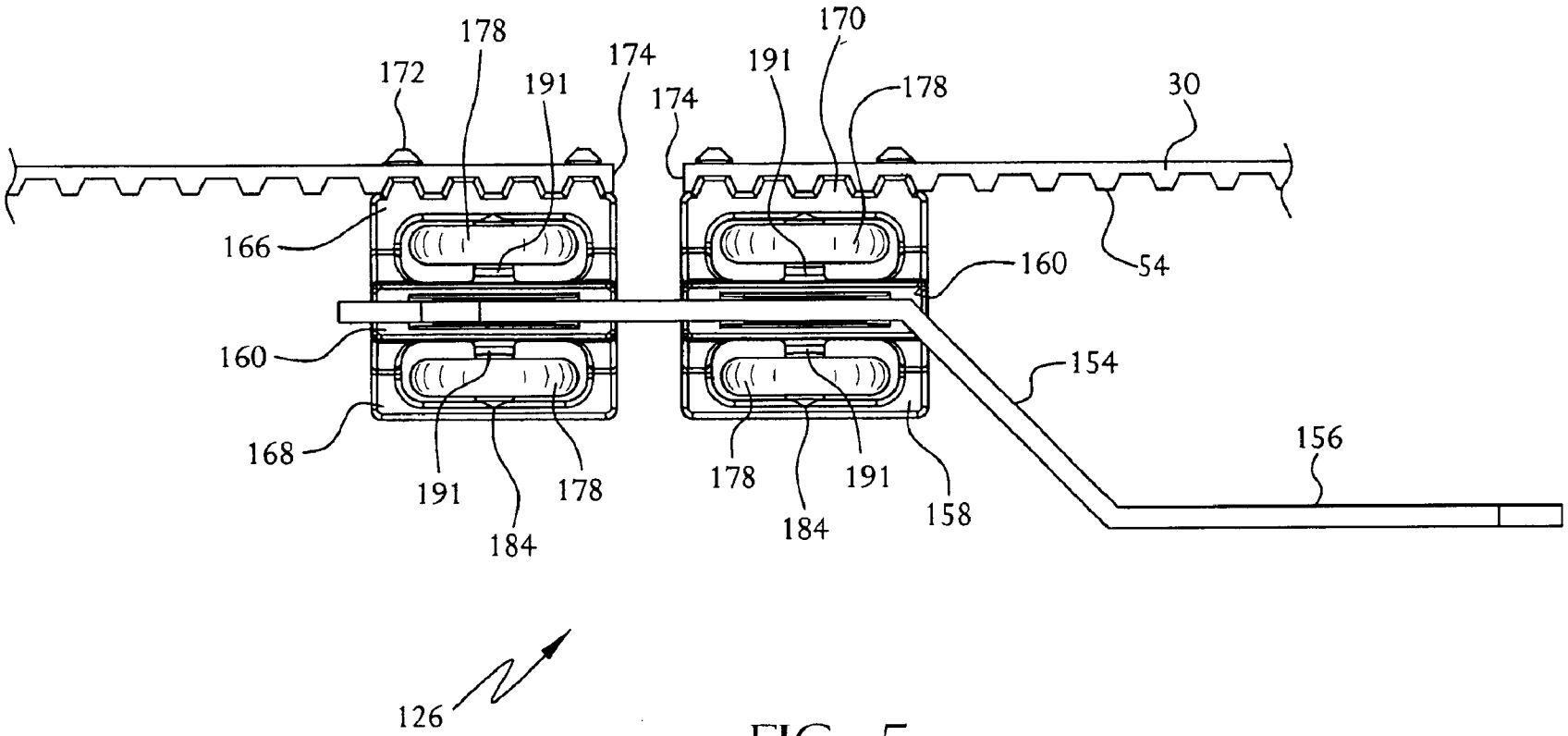
FIG. 5 is a partial bottom plan view showing the engagement between the master car and drive belt of FIG. 1.
Figure 6:
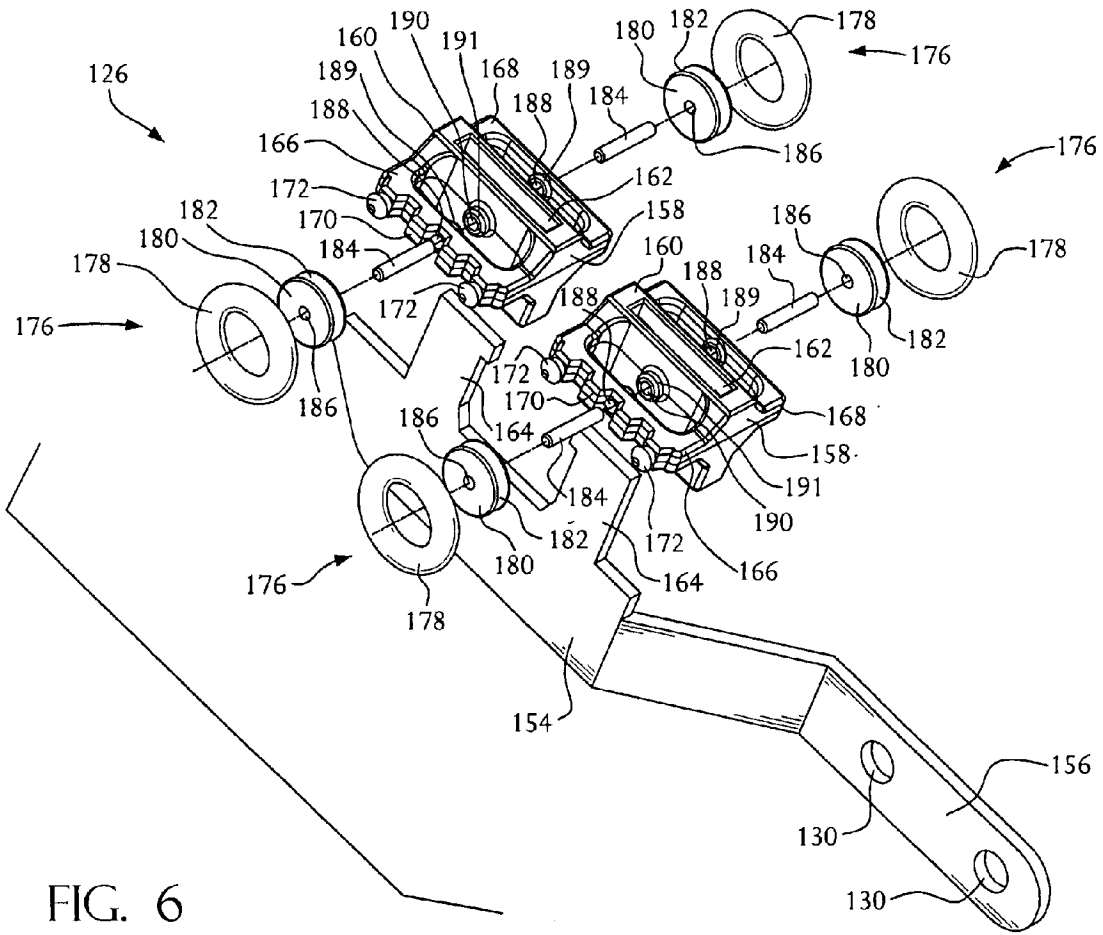
FIG. 6 is an exploded perspective view of the master car of FIG. 1.
Figure 7:
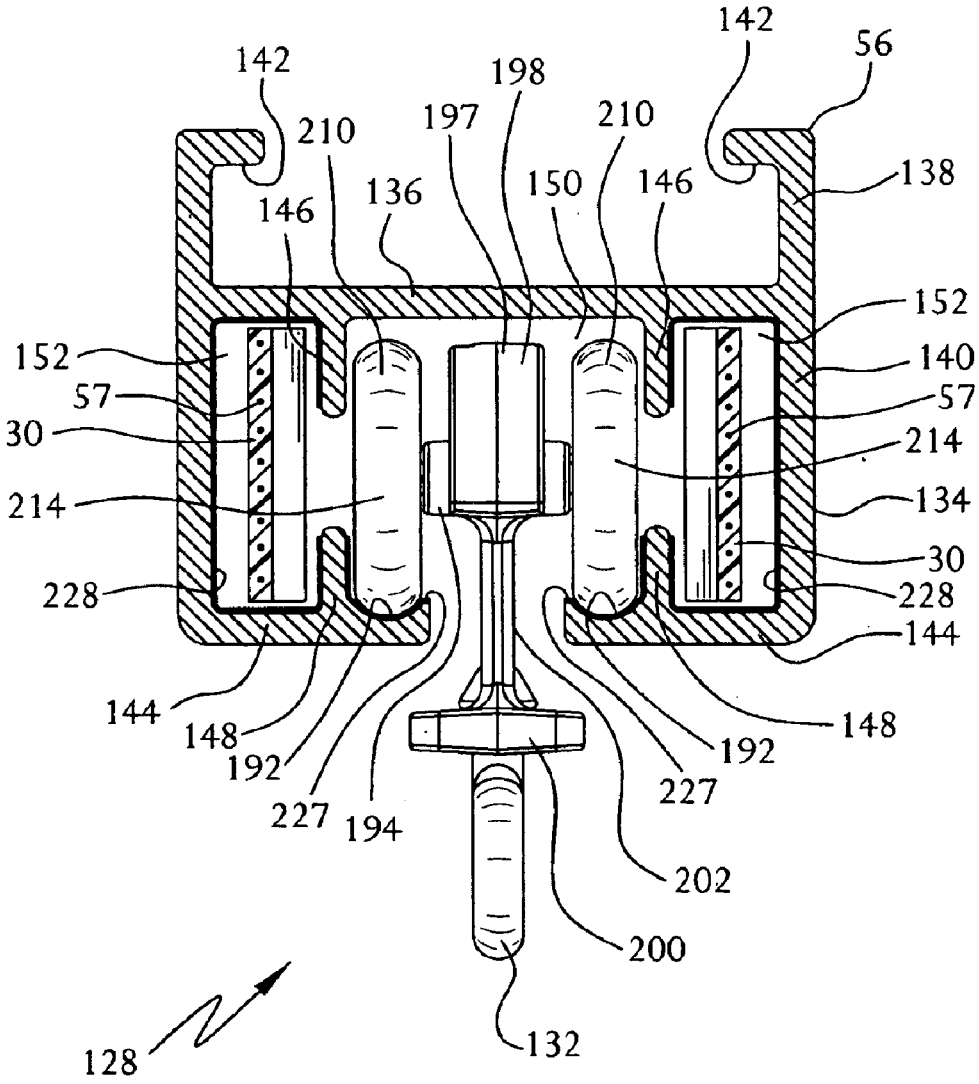
FIG. 7 is a sectional view taken along the lines 7—7 of FIG. 1.

Referring to FIGS. 4–8, the construction of the track 56 and the cars 126, 128 are shown in greater detail. The construction of the elongated track is best seen in the sectional views of FIGS. 4 and 7. The track is preferably made from extruded aluminum. As shown, the elongated track 56 includes opposite sidewalls 134. A cross member 136 separates an upper mounting portion 138 from a lower housing portion 140. The ends of the sidewalls 134 turn inwardly to define elongated lips 142 on opposite sides of the mounting portion 138 for receiving track mounting structure to be described in greater detail. The lower housing portion 140 includes bottom panels 144 and upper and lower interior panels 146, 148, respectively. The panels 144, 146 and 148 collectively define, with the cross member 136 and sidewalls 134, a central car compartment 150 and belt compartments 152 on opposite sides of the car compartment 150. The drive belt 30 extends through the opposite belt compartments 152 as will be described below. The car compartment provides for enclosure of roller portions of the master car 126 (FIG. 4) and the auxiliary cars 128 (FIG. 7).

Figure 4:
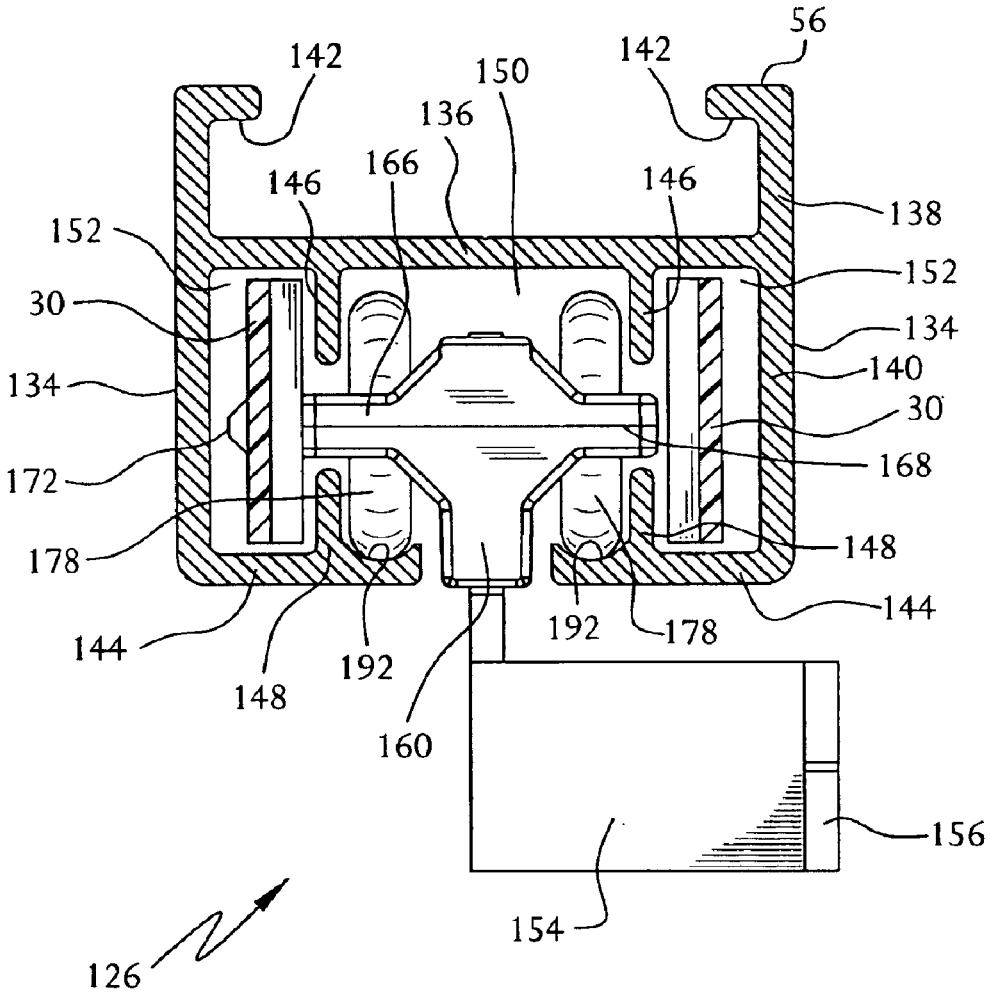
FIG. 4 is a sectional view taken along the lines 4—4 of FIG. 1.

As seen in FIG. 4, the compartments 150, 152 of the housing portion are not completely enclosed. A space is provided between ends of the bottom panels 144 defining an elongated slot for extension of portions of the master car 126 (FIG. 4) and for portions of the auxiliary cars 128 (FIG. 7). Spaces are also provided between the interior panels 146 and 148 to provide for extension of portions of the master car 126 (FIG. 4). As discussed previously, the use of a soft material for the drive belt 30 reduces noise caused by contact with other components of the drapery pull system 10. Referring to FIG. 4, for example, it can be appreciated that the drive belt 30 may contact the track 56 and cause scrubbing noise as the track rubs against the stationary track 56. The portions of the drive belt 30 and the track 56 that can contact each other are referred to as contactable surfaces. The use of soft, resilient material for the drive belt 30 also reduces scrubbing noise by reducing the formation of memory sets in the drive belt. A less flexible drive belt is more likely to take a set around the pulleys 32, 84. When the drapery system remains stationary, the tension on the drive belt impresses the radius of the pulleys into the drive belt material thereby causing the drive belt to take a set in the shape of the pulleys. As described previously, such formations in the drive belt could create additional scrubbing contact between the drive belt 30 and the track 56 when the shade is operated.

Referring to FIGS. 5 and 6, the construction of the master car 126 and its attachment to the drive belt 30 are shown in greater detail. The master car 126 includes a bracket 154 having a drapery attachment portion 156 that includes the openings 130 for support of the drapery to be moved by the drapery pull system 10. The master car 126 further includes a pair of carriage bodies 158 each having a bracket engaging portion 160. The bracket engaging portions 160 of the carriage bodies 158 include elongated openings 162 that receive upstanding tabs 164 of the bracket 154. Each of the carriage bodies 158 further includes opposite first and second arms 166, 168, respectively, that are substantially U-shaped. The first arms 166 include projections 170 adapted for interfit between the teeth 54 of the drive belt 30 as seen in FIG. 5. Each of the carriage bodies 158 further includes at least two attachment elements 172 secured to ends of the projections 170. The belt attachment elements 172 include tapered ends that provide for snap receipt of the attachment elements by openings in the drive belt 30 (not shown) thereby securing the drive belt 30 to the carriage bodies 158. As shown in FIG. 5, the drive belt is not an endless loop and includes ends 174. The securing of the drive belt 30 to the master car 126 serves to couple the ends of the drive belt 30 together such that the drive belt 30 functions as a continuous member.

Each of the carriage bodies 158 includes a pair of opposite roller members 176 rotatably connected to the carriage body between the arms 166, 168 and the bracket engaging portion 160. Each of the roller members 176 includes a substantially toroidal tire 178 having a circular cross section. The roller members of prior art systems are typically made from materials such as nylon or acetal (such as Delrin® sold by DuPont of Wilmington, Del.) having hardness that exceeds 55 on the Shore D durometer scale. The tires 178 are made from a soft, resilient, material. Preferably the tires 178 are made from an elastomer having a hardness of less than 55 on the Shore D durometer scale and more preferably between 70 and 94 on the Shore A durometer scale. Suitable elastomers include polyurethane, Nitrile (Buna-N, a copolymer of Butadiene and Acrylonitrile), and a thermoplastic elastomer sold by Advanced Elastomer Systems of Akron, Ohio under the trademark Santoprene®. A preferred material is Santoprene® having a Shore A durometer hardness of approximately 90. The 90 Shore A Santoprene® material will have a hardness of approximately 35–40 on the Shore D durometer scale, substantially less than the typical material for roller members of the prior art having hardness greater than 55 on the Shore D durometer scale. The use of a soft, resilient material such as Santoprene®, for the tires 178 greatly reduces the noise generated by the rolling contact between the tires and the track in contrast to prior art systems having roller members made from a relatively hard material exceeding 55 on the Shore D durometer scale. The soft material limits skipping or dragging of the tires when the tires encounter surface imperfections in the extruded track such as bumps or burrs, for example.

Each roller member 176 further includes a tire receiving wheel 180 having a concave rim 182. The wheel 180 is made from a material that is relatively rigid with respect to the tire 178. A suitable material for the wheel 180 is LEXAN® 241R a polycarbonate material made by GE Plastics of Schenectady, N.Y. The rim 182 of the wheel 180 has a maximum radius larger than a minimum radius of the tire 178 and the wheel is sufficiently rigid with respect to the tire such that the tire will be slightly stretched when mounted on wheel 180. This serves to maintain engagement between the tire 178 and the wheel 180 and ensure that the wheel and tire rotate together. Each wheel assembly 176 also includes an axle 184 received by an opening 186 in the wheel 180. Each of the axles 184 extends between an opening 188 in a boss 189 formed on one of the arms 166, 168 and one of openings 190 formed in bosses 191 located on opposite sides of the bracket-engaging portion 160. Each of the axles 184 rotatably supports a wheel 180 and tire 178 in one of the carriage bodies 158.

Referring again to FIG. 4, the master car 126 is received within the car compartment 150 of the track 56 such that the arms 166, 168 of the carriage bodies 158 extend between the interior panels 146, 148. The lower part of the bracket-engaging portion 160 of the carriage bodies 158 extends between the bottom panels 144. To limit scrubbing contact between the bottom panels 144 and the carriage bodies 158, the lower part of the bracket-engaging portion 160 of the carriage bodies is reduced in thickness to increase clearance with the bottom panels 144. Arms 166 extend into one of the belt compartments 152 to enable attachment of the attachment elements 172 to the drive belt 30.

The bottom panels 144 of the track 56 include tire receiving surfaces 192 adjacent the ends of the panels 144. The surfaces 192 are curved to present a concave surface to the curved outer surfaces of the tires 178 for nested receipt of the tires by the bottom panels 144. The reduction of generated noise is also facilitated by the curved surfaces 192. The nested receipt of the tires 178 by curved surfaces 192 of track 56 provides for substantially linear tracking of the master car 126 thereby limiting scrubbing contact between the car 126 and the track.

Figure 8:
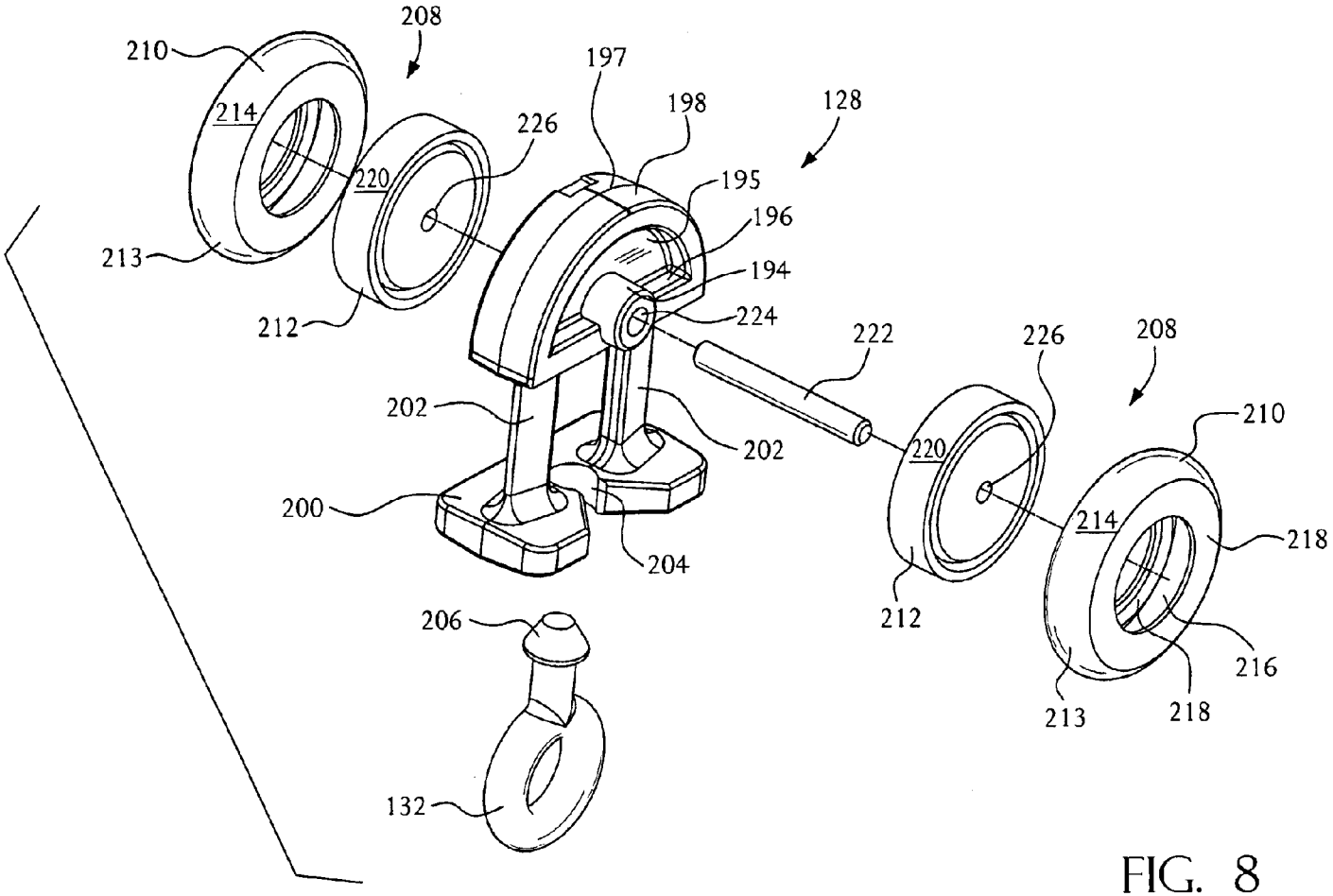
FIG. 8 is an exploded perspective view of one of the auxiliary cars of FIG. 1.

Referring to FIGS. 7 and 8, the construction of the auxiliary cars 128 is shown in greater detail. Each of the auxiliary cars 128 includes a cylindrical hub 194 secured to a cross member 196 of a body frame 198. The hub 194 extends through a panel 195 secured between the cross member 196 and a curved member 197 of the body frame 198. Each auxiliary car 128 further includes an eye support plate 200 connected to the cross member 196 of frame 198 by a pair of spaced legs 202. The eye support plate 200 includes a notch 204 that extends between the legs 202 for snap receipt of a tapered end 206 of eye 132.

Each auxiliary car 128 also includes a pair of roller members 208 having a tire 210 and a wheel 212. The tires 210 of the auxiliary cars are made of a soft, resilient, material. Preferably the tires 210 are made from an elastomer having a hardness of less than 55 on the Shore D durometer scale and more preferably between 70–94 on the Shore A durometer scale. Suitable elastomers include polyurethane, Nitrile (Buna-N, a copolymer of Butadiene and Acrylonitrile), and a thermoplastic elastomer sold by Advanced Elastomer Systems of Akron, Ohio under the trademark Santoprene®. A preferred material is Santoprene(t having a Shore A durometer hardness of approximately 90. The 90 Shore A Santoprene® material will have a hardness of approximately 35–40 on the Shore D durometer scale, substantially less than the typical material for roller members of the prior art having hardness greater than 55 on the Shore D durometer scale. Similar to the tires 178 of the master car 126, the use of soft material for the tires 210 greatly reduces noise generated by rolling contact between the tires and the track and by skipping or dragging of the tires when the tires encounter surface imperfections in the extruded track.

The tires 210 include a track engaging portion 213 having an outer surface 214 that is curved in cross section. The track engaging portion 213 has an inner surface 216 that has a substantially constant radius such that the surface is substantially linear in cross section. The tires 210 also include opposite annular walls 218. As shown in FIG. 8, each of the annular walls 218 has an outer surface that is substantially planar. The tires 210 are attached to the wheels 212 during manufacture in an over-molding process.

The present invention is not limited to any particular construction for the roller members 176, 208 for the master car 126 and auxiliary cars 128, respectively. For example, the construction described above for the roller members 176 could be used for roller members 208 and vice versa.

Each of the auxiliary cars 128 also includes an axle 222 received by an opening 224 in the hub 194. The axle 222 also extends through openings 226 in the wheels 212 for rotatable support of the roller members 208 with respect to the frame 198. Referring to FIG. 7, the auxiliary car is shown positioned within the car compartment 150 of the housing portion 140 of track 56. Similar to the tires 178, the curved surfaces 192 of the car compartment 150 provides nested support of the rounded outer surfaces 214 of the tires 210 that facilitates a substantially linear tracking of the auxiliary cars within the car compartment 150. The enhanced tracking provided by the nested support within track 56 is particularly important for the auxiliary cars 128 because the single axle construction renders the auxiliary cars 128 more likely to deviate from a linear path and into scrubbing contact with the track 56.

The reduction of noise by rolling contact of the tires 178, 210 in the track 56 has been described as being accomplished by using a soft, resilient material for the tires. In an alternative embodiment of the invention, the curved surface 192 of the track 56 could have a coating 227 of a resilient material, such as a resilient polymer, applied thereto as shown in FIG. 7. The application of the resilient material coating 227 to the track 56 provides for the use of either rigid or resilient material for the tires 178, 210.

The reduction of noise by contact between the drive belt 30 and the track 56 has been described as being accomplished by using a soft, resilient material for the drive belt. In an alternative embodiment of the invention, the amount of noise associated with contact between the contactable surfaces of the drive belt 30 and the track 56 can be further reduced by applying a coating 228 of a resilient material, such as a resilient polymer, to the interior surfaces of the belt compartments 152, as shown in FIG. 7.

The single-axle construction of the auxiliary cars 128 also differs from that of the multiple-axle construction of the master car 126 in the following manner. The body frames 198 and the supported eyes 132 of the auxiliary cars 128 are free to pivot about the axles 222 with respect to the track 56 when the auxiliary cars 128 are supported in track 56. The curved upper member 197 provides for clearance between the cars 128 and the housing portion 140 of the track 56 as the cars 128 pivot with respect to the track 56 thereby limiting contact noises between the cars 128 and the track 56. As shown in FIG. 7, the legs 202 of the body frames 198 are tapered such that an intermediate portion of the legs is reduced in cross section. The tapered portion of the legs 202 are located on the cars 128 such that they will be positioned adjacent the bottom panels 144 of track 56 when the auxiliary cars 128 are received in the car compartment 150 of track 56. The reduced portions of legs 202 facilitate clearance between the cars 128 and the track 56. Preferably the reduced portion of legs 202 have a thickness that is less than 25 percent of the distance between bottom panels 144 defining the elongated slot.

Figure 8A:
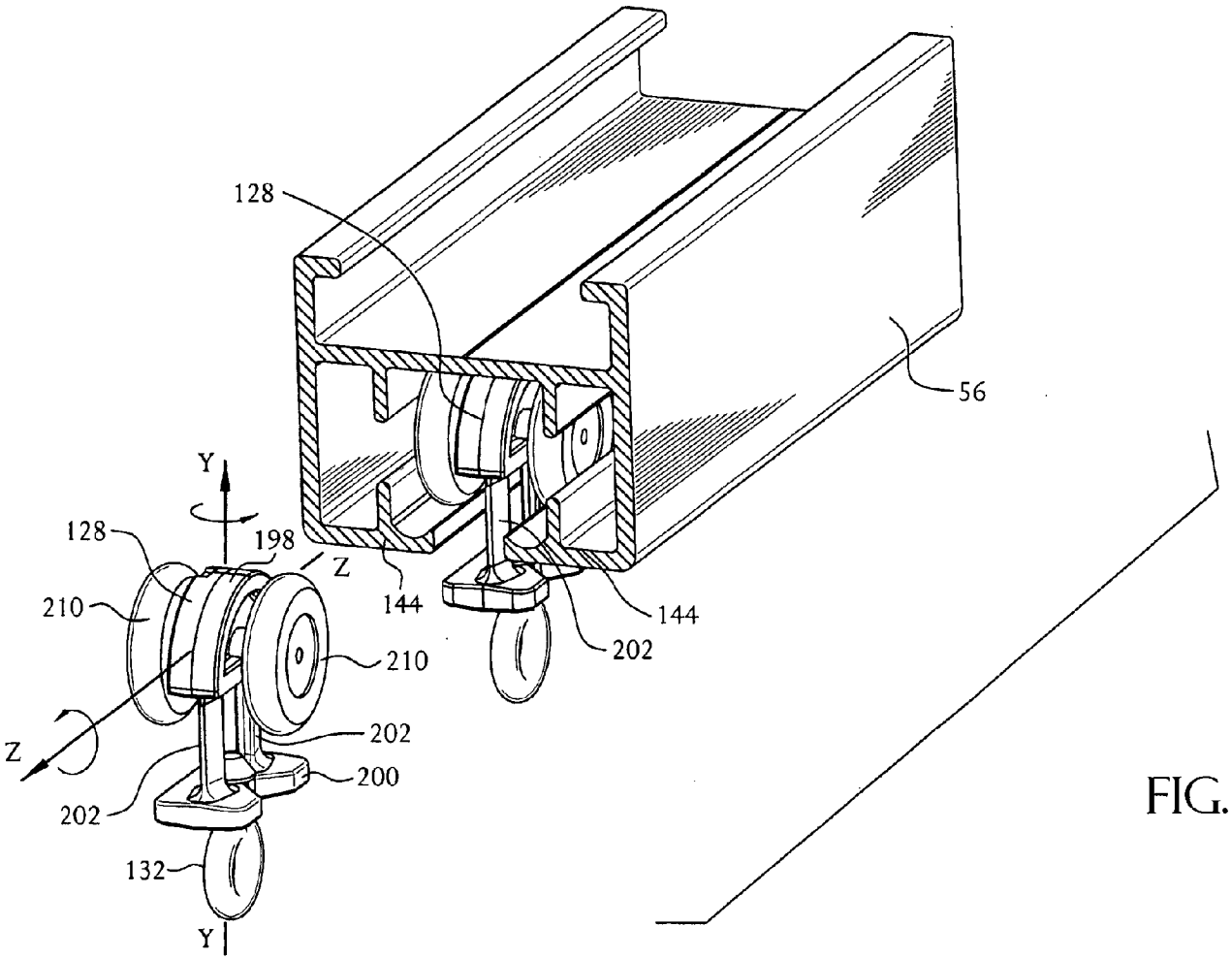
FIG. 8A is an isometric view illustrating axes of rotation for the auxiliary cars of FIG. 1.

Referring to FIG. 8A, an auxiliary car 128 is illustrated within a portion of the track 56 and separated from the track 56 to illustrate potential disruptions in translation which may pivot the car with respect to track 56 into contact with the track. In normal operation of the drapery pull system 10, a substantially linear translation of the auxiliary car 128 along a longitudinal axis, shown as ZZ in FIG. 8A, is intended. However, due to imperfections in the elongated track 56 such as bumps or burrs, for example, such translation along the longitudinal axis may be disrupted. These disruptions can lead to pivot of the car 128 with respect to track 56 about the Z-Z axis (roll). The disruptions may also cause pivot of the car 128 about the yaw axis YY with respect to track. Disruptions about the roll axis ZZ can lead to undesirable contact between the legs 202 and the bottom panels 144 of track 56. Disruptions about the yaw axis YY can lead to undesirable contact between the legs 202 and the bottom panels 144 of track 56.

The geometry of prior art auxiliary cars allows for only limited rotation about the roll or yaw axes before scrubbing contact occurs between the auxiliary car and the track. In the presently preferred embodiment of the invention, the additional clearance provided by the reduced portions of legs 202 allows for disruptions of up to 15 degrees in either direction from vertical about the roll axis before contact between the legs 202 and the bottom panels 144. Similarly, disruptions of up to approximately 15 degrees in either direction about the yaw axis are allowed before the legs 202 contact bottom panels 144 of track 56.

Figure 9:
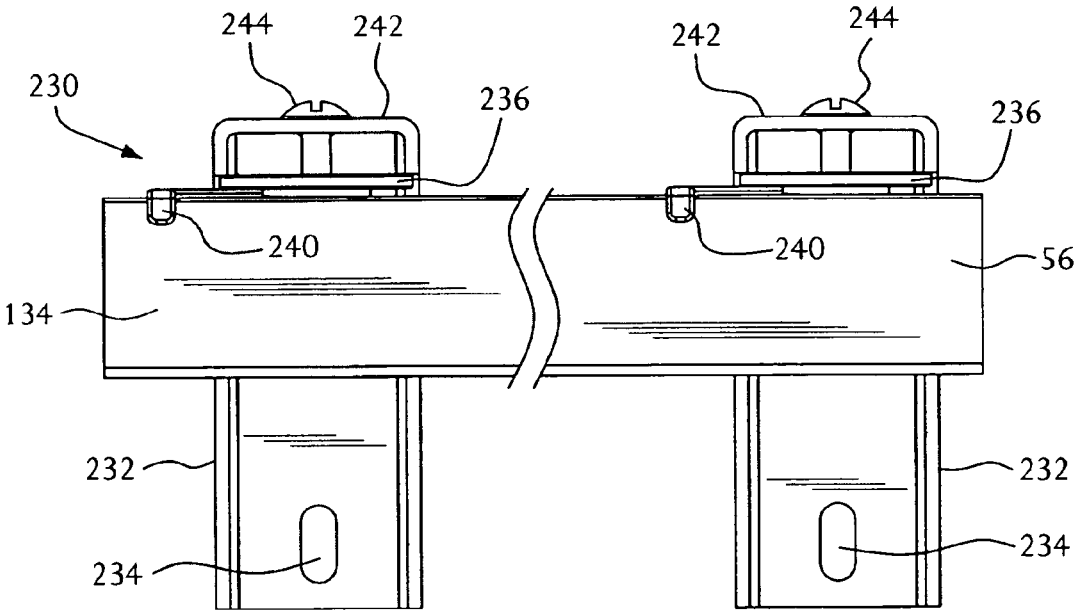
FIG. 9 is a side elevational view of a track according to the present invention shown secured to mounting brackets by cam locks for wall-mounting of the track.
Figure 10:
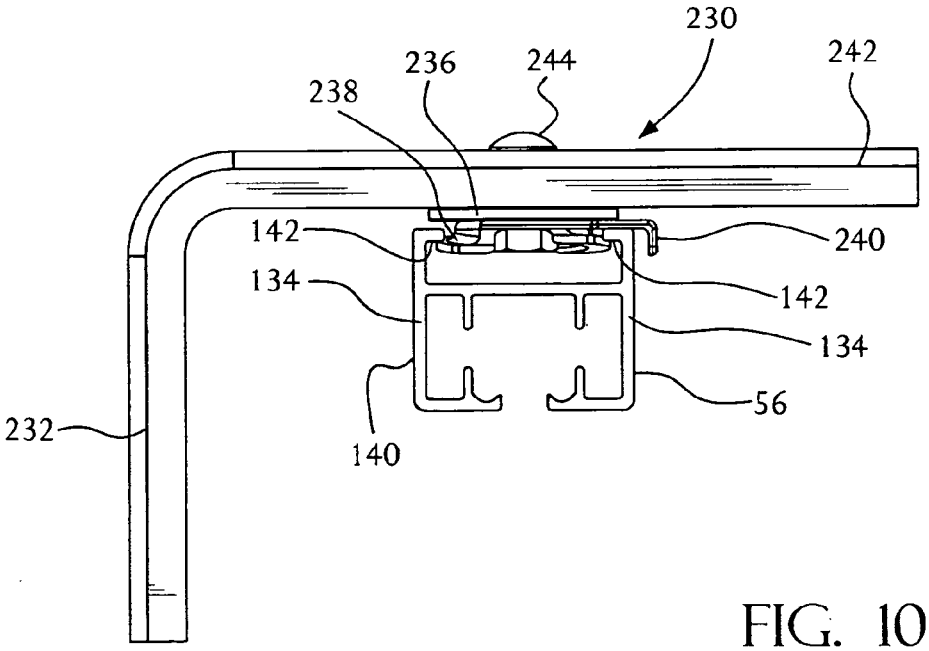
FIG. 10 is an end view of the track of FIG. 9.

Referring to FIGS. 9 and 10, there is shown a mounting assembly 230 for mounting the track 56 to a substantially vertical wall (not shown). The mounting assembly 230 includes a pair of L-shaped brackets 232 each securable to a wall through slots 234, by mounting screws (not shown) for example. The mounting assembly 230 further includes a pair of cam locks 236 having ramping cam notches 238 pivotably supported by the brackets 232 in the manner to be described below. The cam notches 238 are sized to permit receipt of the cam locks 236 between the inwardly turned lips 142 of track 56 when the cam locks 236 are pivoted to a first position. Upon receipt of the cam locks between the lips 142, pivoting of the cam locks 236 with respect to the track 56 to a second position brings the ramping cam notches 238 into engagement with lips 142 as shown in FIG. 10. Each of the cam locks 236 is attached to one of the brackets 232 by a bolt 244 extending through an opening (not shown) in the bracket to engage the cam lock as seen in FIG. 9. The attachment of the cam locks 236 to the brackets 232 in this manner allows for the pivot of the cam locks with respect to the bracket. Each of the cam locks 236 includes a tab projection 240 that facilitates pivoting of the cam lock 236 between the first and second positions described above.

A typical quiet residential space has an average background sound level of about 27 dBA. When measured in an average 22 dBA ambient room, a typical prior art motorized drapery pull system creates an average sound level of about 55 dBA during normal operation. In a similar test of a drapery pull system according to the present invention, in which the track contacting portions of the roller members were made from polyurethane, an average operating sound level below about 47 dBA resulted during normal operation of the system. The motorized drapery pull systems, for which the sound level measurements are given above, include a drapery having dimensions of about 65 inches wide by 64 inches tall suspended from one master car and 15 auxiliary cars; with sound level measurements being taken from about 4 feet from the motor drive unit.

A drapery pull system according to the present invention, in which the track contacting portions of the roller members were made from a 90 Shore A durometer hardness Santoprene® was also tested for normal operating sound level. Average normal operating sound levels of less than approximately 40 dBA were measured at a distance of approximately 4 feet from the track.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather should be construed in breadth and scope in accordance with the recitation of the appended claims.

What is claimed is:

1. A drapery pull system for moving a suspended drapery or the like comprising:

an elongated track comprising a housing portion that defines a car compartment;

a master car received within the car compartment of the track, the master car comprising at least one pair of roller members each rotatably supported by the master car, a plurality of auxiliary cars received within the car compartment of the track, each of the auxiliary cars comprising a pair of roller members rotatably supported by the auxiliary car, each of the roller members of the master car and auxiliary cars defining a surface that is curved in cross section, the curved surface of the roller members engaging a pair of curved surfaces defined by the car compartment of the track, the curved surfaces of the track adapted to provide for nested receipt of the roller members by the track to facilitate a substantially linear tracking of the master car and the auxiliary cars within the car compartment of the track; and a drive system having a motor and a drive shaft rotatably driven by the motor, the motor being reversible for driving the drive shaft in each of opposite rotational directions, the drive system including a drive pulley having notches formed about an outer surface, the drive pulley engaging the drive shaft for rotation therewith, the drive system further including a drive belt having a toothed surface engaging the notches of the drive pulley to be driven by the drive system, the master car comprising a pair of carriage bodies connected by a bracket, each of the carriage bodies defining a plurality of projections adapted for interfit with the toothed surface of the drive belt for driving the master car in one of two opposite directions within the car compartment depending on the rotational direction of the drive shaft, the master car attachable to a drapery to provide for movement of the drapery, each of the auxiliary cars attachable to the drapery to provide for rolling support of the drapery when the drapery is moved by the master car, wherein at least a portion of each of the roller members that defines the surface that is curved in cross section is made from a resilient material having a hardness that is less than 55 on the Shore D durometer scale to reduce noise by limiting skipping or dragging of the roller members upon contact of the curved surface of the roller member with surface imperfections of the track and to reduce noises associated with rolling contact between the roller members and the track.

2. The drapery pull system according to claim 1, wherein the housing portion of the track further defines a pair of belt compartments on opposite sides of the car compartment.

3. The drapery pull system according to claim 2, wherein the drive belt is made from a resilient material for limiting noise associated with contact between the belt and the drive pulley and to limit noise associated with scrubbing contact between the drive belt and a portion of the track.

4. The drapery pull system according to claim 1, wherein each of the roller members of the master car comprises a wheel having a concave edge and a tire having a substantially circular cross section about a circumferential axis at a predetermined radial distance from a center of rotation of the tire, the tire being mounted on the edge of the wheel.

5. A drapery pull system for moving a suspended drapery or the like comprising:

an elongated track comprising a housing portion that defines a car compartment;

a master car received within the car compartment of the track, the master car comprising at least one pair of roller members each rotatably supported by the master car, each of the roller members of the master car comprising a wheel having a concave edge and a tire having a substantially circular cross section about a circumferential axis at a predetermined radial distance from a center of rotation of the tire, the tire being mounted on the edge of the wheel, a plurality of auxiliary cars received within the car compartment of the track, each of the auxiliary cars comprising a pair of roller members rotatably supported by the auxiliary car, each of the roller members of the master car and auxiliary cars defining a surface that is curved in cross section, the curved surface of the roller members engaging a pair of curved surfaces defined by the car compartment of the track, the curved surfaces of the track adapted to provide for nested receipt of the roller members by the track to facilitate a substantially linear tracking of the master car and the auxiliary cars within the car compartment of the track; and a drive system having a motor and a drive shaft rotatably driven by the motor, the motor being reversible for driving the drive shaft in each of opposite rotational directions, the drive system including a drive belt connected to the master car and operably connected to the drive shaft for driving the master car in one of two opposite directions within the car compartment depending on the rotational direction of the drive shaft, the drive belt including a toothed surface, the master car attachable to a drapery to provide for movement of the drapery, each of the auxiliary cars attachable to the drapery to provide for rolling support of the drapery when the drapery is moved by the master car, wherein at least a portion of each of the roller members that defines the surface that is curved in cross section is made from a resilient material having a hardness that is less than 55 on the Shore D durometer scale to reduce noise by limiting skipping or dragging of the roller members upon contact of the curved surface of the roller member with surface imperfections of the track and to reduce noises associated with rolling contact between the roller members and the track, the master car comprising a bracket defining a pair of tabs and a pair of carriage bodies each defining an opening in which the tabs of the bracket are received, each of the carriage bodies further defining a plurality of projections that are adapted for interfit with the toothed surface of the drive belt, each of the carriage bodies further comprising at least one belt attachment element secured to one of the projections, the at least one belt attachment element comprising a tapered end to provide for snap receipt of the attachment element by an opening in the drive belt to secure the master car to the drive belt.

6. The drapery pull system according to 1, wherein the track further comprises a mounting portion that includes sidewalls having inwardly turned ends that define lips on opposite sides of the mounting portion, the system further including at least one cam lock having cam notches defined about an outer edge thereof, the cam notches engageable with the lips of the mounting portion upon pivot of the at least one cam lock with respect to the track.

7. The drapery pull system according to claim 1, wherein each of the roller members of the auxiliary cars comprises a wheel and a tire, each tire comprising a track engaging portion having an outer surface curved in cross section and an inner surface, each tire further comprising annular sidewalls located on opposite sides of the track engaging portion, each tire mounted on a wheel such that the wheel is located within the inner surface of the tire between the annular sidewalls of the tire.

8. A drapery pull system for translating a suspended drapery or the like comprising:

an elongated track having a first end and a second end and comprising a housing portion, the housing portion defining a car compartment and a pair of belt compartments located on opposite sides of the car compartment, the car compartment defining at least one car contact surface, each of the belt compartments defining at least one belt contactable surface;

a drive belt received within the belt compartments of the track, the drive belt having a pulley contact surface and at least one track contactable surface;

a drive pulley rotatably supported adjacent the first end of the track, the drive pulley including a belt contact surface, the pulley contact surface of the drive belt contacting the belt contact surface of the drive pulley such that rotation of the drive pulley results in translation of the drive belt within the belt compartments of the track;

an idler pulley rotatably supported adjacent the second end of the track, the idler pulley including a belt contact surface, the pulley contact surface of the belt contacting the belt contact surface of the idler pulley; and a drapery support assembly comprising at least one car received within the car compartment of the track, the car operably connected to the drive belt for translation of the car with respect to the track, the car comprising at least one roller member rotatably supported by the car, the roller member having a track contact surface that contacts the car contact surface of the track, the car attachable to a drapery for translation of the drapery with respect to the track, the car contact surface of the track and the track contact surface of the car defining a first contact surface pair, the pulley contact surface of the drive belt and the belt contact surface of the drive pulley defining a second contact surface pair, the pulley contact surface of the drive belt and the belt contact surface of the idler pulley defining a third contact surface pair and the at least one track contactable surface of the drive belt and each of the belt contactable surfaces of the track defining a fourth contact surface pair, the pulley contact and track contactable surfaces of the drive belt having a hardness less than 94 on the Shore A hardness scale, each of the first and second contact surface pairs including at least one surface having a hardness that is less than 55 on the Shore D durometer scale, and wherein at least the portion of the track that defines the belt contactable surfaces comprising a polymer material having a Shore A durometer hardness that is less than 94.

9. The drapery pull system according to claim 8, wherein at least a portion of the track comprises a rigid material and wherein the portion of the track defining the belt contactable surface comprises a coating of the polymer material on the rigid material.

* * * * *